US007607493B2

(12) United States Patent
Erhardt

(10) Patent No.: US 7,607,493 B2
(45) Date of Patent: Oct. 27, 2009

(54) HAND-HELD ELECTRIC POWER TOOL

(75) Inventor: Jochen Erhardt, Klosterlechfeld (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 12/001,255

(22) Filed: Dec. 10, 2007

(65) Prior Publication Data

US 2008/0223592 A1 Sep. 18, 2008

(30) Foreign Application Priority Data

Dec. 12, 2006 (DE) ..... 10 2006 000 515

(51) Int. Cl.
*E21B 6/00* (2006.01)
*E21B 6/04* (2006.01)

(52) U.S. Cl. ..... 173/216; 173/217

(58) Field of Classification Search ..... 173/48, 173/216, 217; 74/371; 192/48.5; 200/11 R, 200/565; 408/124
See application file for complete search history.

(56) References Cited

U.S. PATENT DOCUMENTS 3,934,688 A 1/1976 Sides et al.
4,726,430 A * 2/1988 Hendrikx et al. ..... 173/109
4,895,212 A * 1/1990 Wache ..... 173/48
5,125,461 A * 6/1992 Hoser ..... 173/48
5,992,257 A * 11/1999 Nemetz et al. ..... 74/371
6,460,627 B1 10/2002 Below et al.
6,550,546 B2 * 4/2003 Thurler et al. ..... 173/48
2006/0113097 A1 6/2006 Simm et al.

FOREIGN PATENT DOCUMENTS

EP 0566926 10/1993

OTHER PUBLICATIONS

European Search Report Jul. 2008.

* cited by examiner

*Primary Examiner*—Rinaldi I. Rada
*Assistant Examiner*—Nathaniel Chukwurah
(74) *Attorney, Agent, or Firm*—Abelman, Frayne & Schwab

(57) ABSTRACT

A hand-held electric power tool (2) includes a switching gear unit (6) which has at least two switching stages, including an impact mechanism (10) which can be switched on, and a mode switch (4) with which the switching gear unit (6) can be switched back and forth between the switching stages. The impact mechanism (10) can be switched on and off, and the mode switch (4) is movement-coupled with a gear unit switching mechanism (16) of the switching gear unit (6) and with an impact mechanism switching mechanism (18) of the impact mechanism (10). The impact mechanism switching mechanism (18) has a swiveling mechanism which can be swiveled by the mode switch (4) between an active position, in which the impact mechanism (10) can be activated, and a passive position in which the impact mechanism (10) is deactivated.

10 Claims, 7 Drawing Sheets

HAND-HELD ELECTRIC POWER TOOL

BACKGROUND OF THE INVENTION

1. Field of the Invention

The invention relates to an electric hand-held power tool having a switching gear unit having at least two switching stages. Further, the hand-held power tool has an impact mechanism which can be switched on and off selectively, and a mode switch by means of which the switching gear unit can be switched back and forth between the switching stages and the impact mechanism can be switched on and off. To this end, the mode switch is movement-coupled with gear unit switching means of the switching gear unit and with impact mechanism switching means of the impact mechanism.

2. Description of the Prior Art

In hand-held power tools of the kind mentioned above, the various gear unit switching stages and the impact mechanism can be switched by a single movement of the hand. This enables a more comfortable operation and facilitates manufacture of the device.

DE 10 2004 057 686 A1 discloses a switching device for an electric tool which has a rotatably mounted operating control and two separate switching elements. A first switching element serves to switch a switching gear unit and a second switching element serves to activate an electronic switching process which serves, for example, to switch the impact mechanism on and off. For this purpose, transmission elements are provided with which a rotating movement of the operational elements can be transformed into mutually perpendicular displacements of the switching elements.

It is disadvantageous in the known switching device that the switching elements which are displaceable perpendicular to one another require a relatively large installation space.

It is the object of the present invention to overcome the above-mentioned disadvantages and to reduce the required installation space in a hand-held electric power tool.

SUMMARY OF THE INVENTION

This and other objects of the present invention, which will become apparent hereinafter, are achieved, according to the invention, with a hand-held power tool in which the impact mechanism switching means have a swiveling mechanism which can be swiveled by the mode switch between an active position in which the impact mechanism can be activated, and a passive position in which the impact mechanism is deactivated. A swiveling mechanism of this type can be so designed that it occupies the same amount of space, at least predominantly, in different switching positions. Accordingly, the installation space required for the moving impact mechanism switching means is relatively small, which in turn makes possible a more compact manner of constructing the hand-held power tool.

In a particularly preferred embodiment form, the swiveling mechanism has a switch-side swiveling member which is held so as to be swivelable at a rotary bearing. This swiveling member is movement-coupled with the mode switch and actuates actuating means, depending on whose position the impact mechanism can be switched on and off. A stable swiveling mechanism, which maintains the impact mechanism securely in a selected operating state, can be provided by designing the swiveling member in this way.

A cam element is advantageously provided at the mode switch, and the switch-side swiveling member and gear unit switching means can be actuated by means of this cam element. The switching positions of the gear unit can accordingly be matched directly to the switching positions of the impact mechanism. In this way, it can be ensured, for example, that a rotational speed that is particularly suitable for the impact mechanism is adjusted when the impact mechanism is switched on.

The actuating means preferably have a swiveling member on the impact mechanism side that is held at a second rotary bearing so as to be swivelable transverse to the switch-side swiveling member. In this way, the operating direction of the impact mechanism switching means can be changed in order to switch the impact mechanism in a more stable and exact manner and to reduce the required installation space.

The swiveling member on the impact mechanism side advantageously has a blocking stop by means of which a first ratchet disk of the impact mechanism can be spaced from a second ratchet disk in the passive position. The impact mechanism can accordingly be switched off in a particularly simple manner.

In addition, the swiveling member on the impact mechanism side is advantageously swiveled by the switch-side swiveling member in the active position into a position in which the spacing of the ratchet disks by the blocking stop is canceled. In this way, it is possible to switch the impact mechanism on and off by means of a particularly simple but stable switching arrangement.

The swiveling member on the impact mechanism side is biased in the passive position so that the impact mechanism cannot be switched on unintentionally in the corresponding position of the mode switch.

For this purpose, it is advantageous when the bias is generated by a leg spring. A leg spring of this type is particularly well-suited for arranging at the swiveling member on the impact mechanism side. The leg spring requires only slightly more additional installation space.

The first swiveling member and second swiveling member are advantageously constructed as bent-punched parts so that the swiveling mechanism can be produced in an economical manner.

Further, the gear unit switching means have a shift element by means of which a gear group of the switching gear unit can be displaced between the switching stages and which is constructed as a bent-punched part. This makes it especially easy to actuate the switching gear unit which again reduces the manufacturing cost of the switching arrangement overall. Further, a shift element of this kind requires only slightly more additional installation space.

Further, in an advantageous manner, the first rotary bearing is provided between the switch-side swiveling member and the shift element and is formed by a pin which penetrates into a passage. The passage can be shaped out at one of the two bent-punched parts during production thereof and the pin can be fastened to the other bent-punched part, for example, by orbital riveting, so that the first rotary bearing can be manufactured in a particularly economical manner.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENTS

Figure 1:
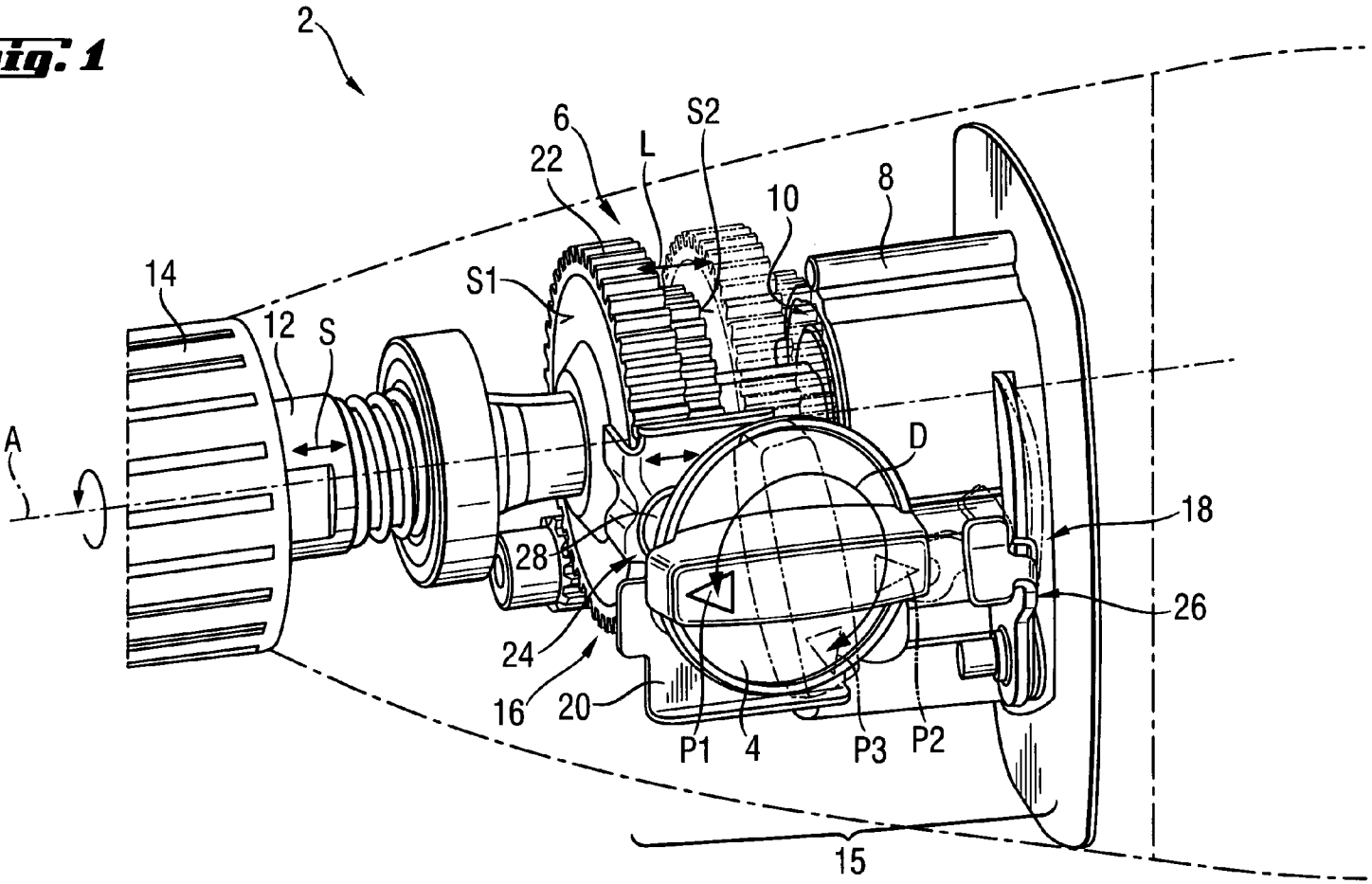
FIG. 1 a perspective view of a switching arrangement of a hand-held power tool according to the invention.

FIG. 1 shows a front part of a hand-held power tool 2 in the form of a hammer drill. This hand-held power tool 2 has a mode switch 4 by means of which a switching gear unit 6 and an impact mechanism 10 received in an impact mechanism housing 8 can be switched back and forth between different switching stages. The mode switch 4 is constructed as a rotary switch.

In this way, a tool spindle 12, at which a tool holder 14 is held, can be driven by the switching gear unit 6 around a work axis A at different rotational speeds, on one hand. On the other hand, recurring pulsed percussive force S can be applied to the tool spindle 12 selectively in addition by means of the impact mechanism 10 along the work axis A. For this purpose, the tool spindle 12 is supported so as to be rotatable and axially displaceable.

In order to actuate the switching gear unit 6 and the impact mechanism 10 by means of the individual mode switch 4, a switching arrangement, designated in its entirety by 15, is provided between the mode switch 4, the switching gear unit 6 and the impact mechanism 10. The switching arrangement 15 comprises gear unit switching means 16 for actuating the switching gear unit 6 and impact mechanism switching means 18 for actuating the impact mechanism 10. The gear unit switching means 16 and the impact mechanism switching means 18 are movement-coupled with the mode switch 4.

The gear unit switching means 16 are substantially formed by a shift element 20 by which two faces S1, S2 of a two-stage gear group 22 of the switching gear unit 6 which face away from one another are acted upon by axial pressure. The gear group 22 is supported on the tool spindle 12 so as to be displaceable in axial direction but fixed with respect to rotation relative to it and can accordingly be moved back and forth along the work axis A by the shift element 20.

The impact mechanism switching means 18 comprises a swiveling mechanism which has a switch-side swiveling member 24 and a swiveling member 26 on the impact mechanism side. The switch-side swiveling member 24 has a first swiveling arm 28 which engages with the mode switch 4 and serves to actuate the swiveling member 26 on the impact mechanism side. The swiveling member 26 on the impact mechanism side functions as actuating means for switching the impact mechanism 10 on and off.

FIG. 1 shows the mode switch 6 in a first rotational position, defined by arrow P1, in which the tool spindle 12 can be driven only at a low rotational speed and the swiveling members 24, 26 are in a passive position in which the impact mechanism 6 is deactivated.

The mode switch 4 can be rotated out of this first rotational position in rotating direction D into a second rotational position which is offset by about 180° and by a further 80° to 90° into a third rotational position as is indicated by dash-dot arrows P2 and P3 of the mode switch 4.

Figure 2:
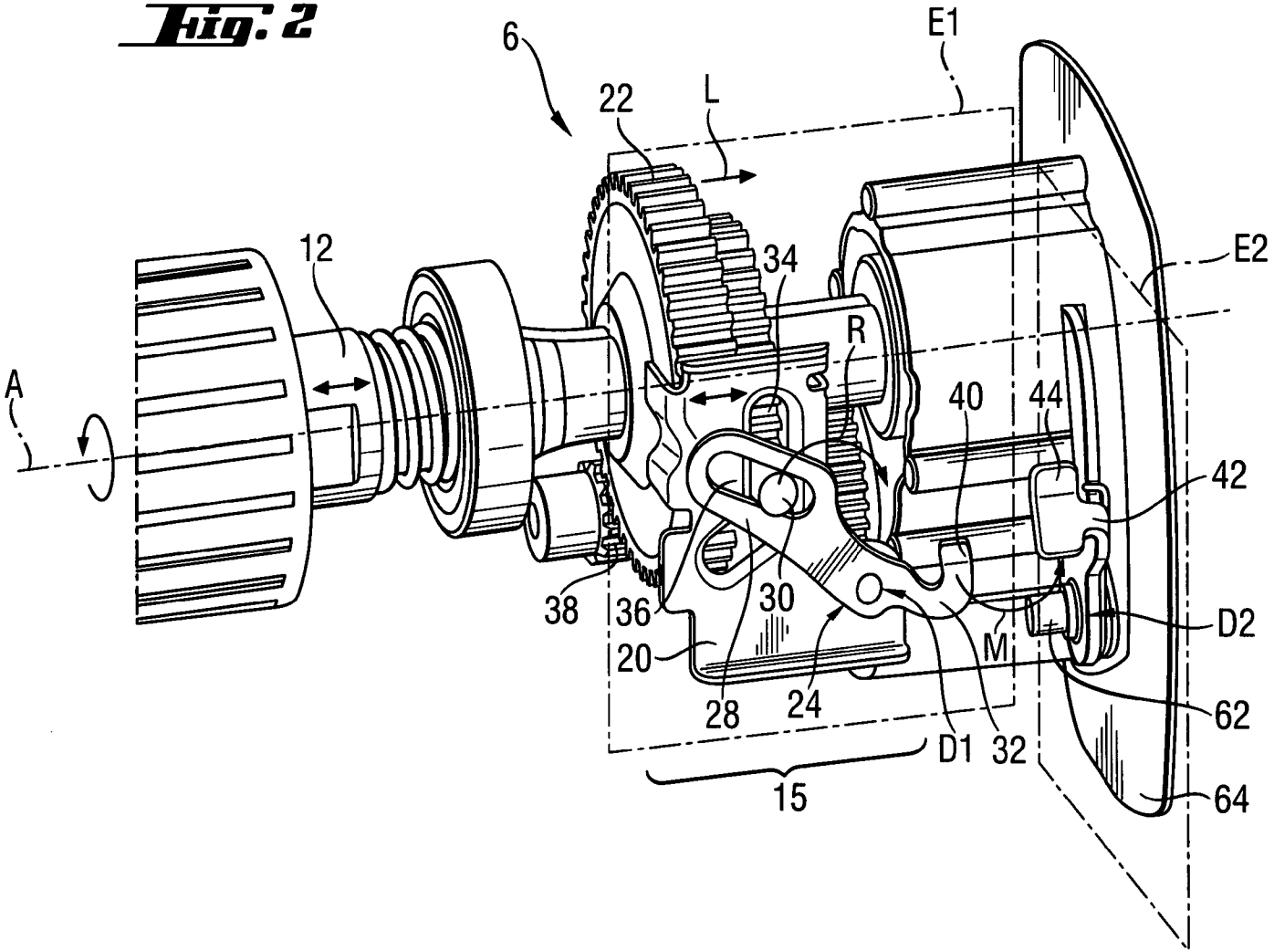
FIG. 2 a perspective view of the switching arrangement according to FIG. 1 in a first switching position with the mode switch removed.

FIG. 2 shows the switching arrangement 15 in a first switching position corresponding to the first rotational position of the mode switch 4. The mode switch 4 is indicated only by a pin-shaped cam element 30. This cam element 30 functions as coupling means engaging with a slotted piece 34 incorporated in the shift element 20 and with an elongated hole 36 which is provided at the first swiveling arm 28 of the switch-side swiveling member 24 and, like the slotted piece 34, functions as counter-coupling means.

As can also be seen from FIG. 2, the position of the shift element 20 along the work axis A in which the first switching step is set at the switching gear unit 6 is fixed by the engagement of the cam element 30 in the slotted piece 34. In this switching step, the gear group 22 meshes with a first working pinion 38 of a drive unit, not shown more closely.

At the same time, the cam element 30 fixes a swiveling position of the switch-side swiveling member 24 by engaging with the elongated hole 36 in this first rotating position of the mode switch 4. In so doing, a second swiveling arm 32 of the switch-side swiveling member 24 is directed downward. Further, in this switching position a contacting member 40 which is formed at the second swiveling arm 32 by a curved end portion is at a distance from a carrying member 42 of the swiveling member 26 on the impact mechanism side, this carrying member 42 forming a contacting surface 44 that is inclined relative to a first swiveling plane E1 of the switch-side swiveling member 24 in which the switch-side swiveling member 24 is swivelable. The swiveling member 26 on the impact mechanism side is swivelable in a second swiveling plane E2 which extends substantially perpendicular to the first swiveling plane E1 of the switch-side swiveling member 24.

Figure 3:
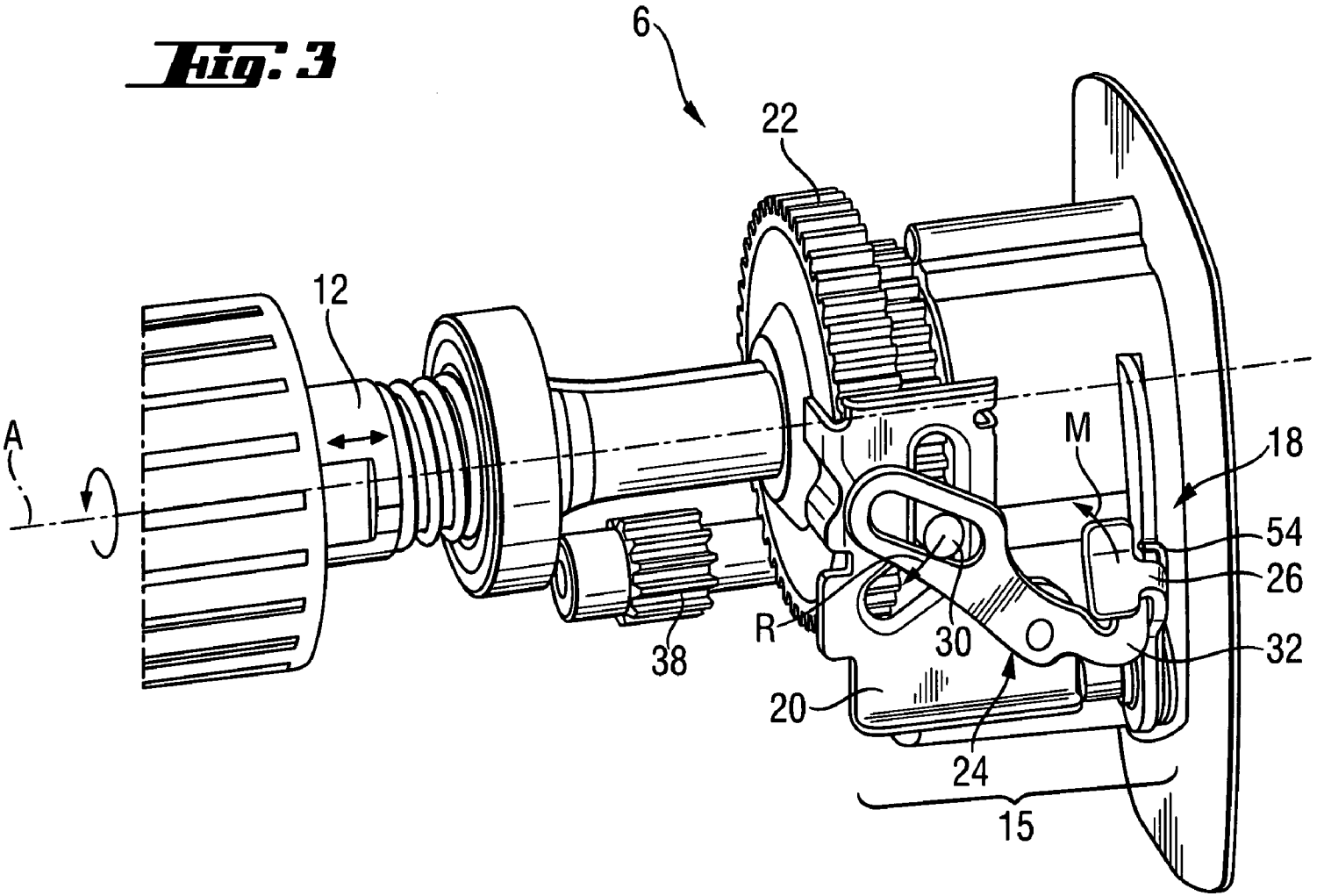
FIG. 3 a perspective view of the switching arrangement according to FIG. 2 in a second switching position.

Proceeding from this first rotational position, the cam element 30 is swiveled in a direction R when the mode switch 4 rotates, the gear group 22 is displaced in direction L by the shift element 20, and the contacting member 40 is swiveled in direction M. After a rotation of the mode switch 4 by about 180°, the second rotational position of the mode switch 4 is reached and a second switching position of the switching arrangement 15 is reached according to FIGS. 3 and 4.

Figure 4:
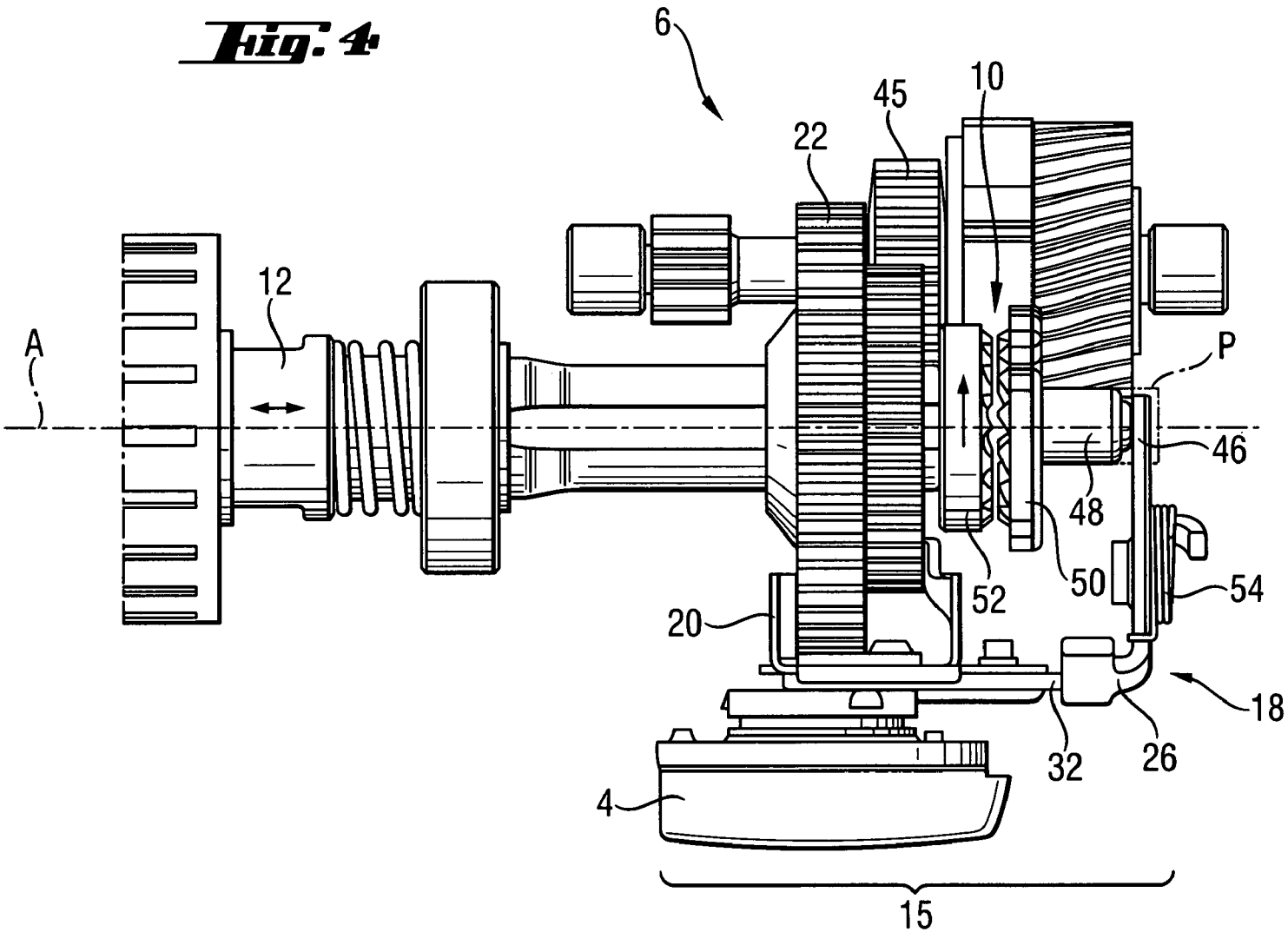
FIG. 4 a direct top view of the top of the switching arrangement according to FIG. 3.

In this second switching position of the switching arrangement 15, the gear group 22 meshes with a second driving pinion 45 which, together with the gear group 22, forms a multiplication that is appreciably greater compared to the first switching step as can be seen particularly from FIG. 4. Accordingly, a relatively high rotational speed is applied to the tool spindle 12 in the second switching step of the switching gear unit 6. At the same time, the second swiveling arm 32 of the switch-side swiveling member 24 is arranged adjacent to the swiveling member 26 on the impact mechanism side. However, the swiveling mechanism remains in its passive position.

In this passive position, a part of the swiveling member 26 on the impact mechanism side which functions as a blocking stop 46 projects into an axial movement path P of the displaceable tool spindle 12 (see FIG. 4). A rear end 48 of the tool spindle 12 can contact this blocking stop 46 so that its displacement is blocked in axial direction toward the rear during operation. The swiveling member 26 on the impact mechanism side is biased by a leg spring 54 in the blocking position in the movement path P.

As can further be seen from FIG. 4, the impact mechanism 10 is constructed as a ratchet impact mechanism and has a fixed ratchet disk 50 which is held in fixed position in the hand-held power tool 2, and a movable ratchet disk 52. The movable ratchet disk 52 is fixedly connected to the tool spindle 12 and consequently moves along with the latter in the rotating direction as well as in axial direction.

In the passive position shown in the drawing, the movable ratchet disk 52 is held at a distance to the fixed ratchet disk 52 in axial direction by the rear end 48 of the tool spindle 12 contacting the blocking stop 46. Therefore, the cooperation of the two ratchet disks 50, 52 for applying impacts to the work spindle 12 is blocked in the second switching position of the switching arrangement 15 as well as in the first switching position.

Figure 5:
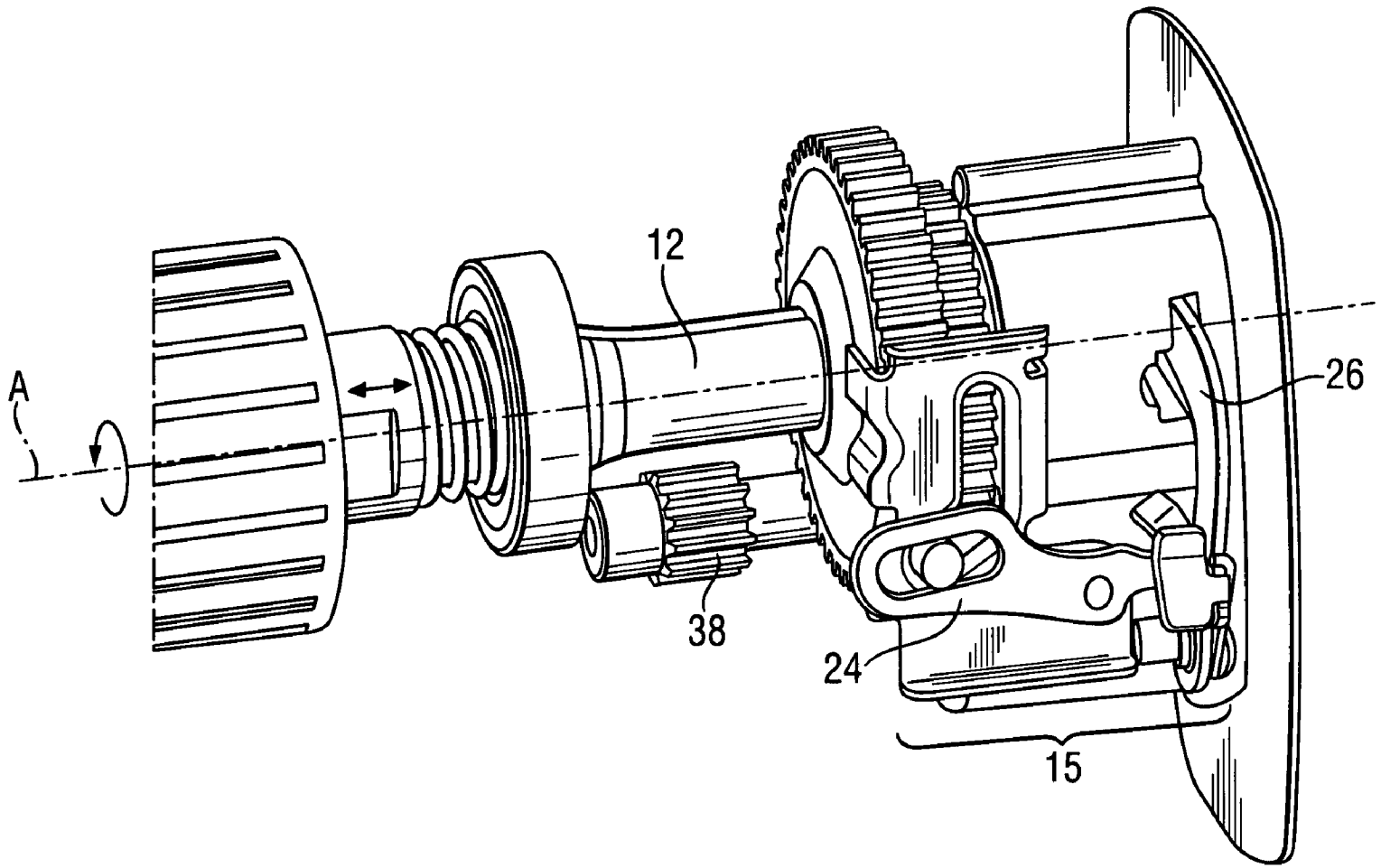
FIG. 5 a perspective view of the switching arrangement according to FIG. 3 in a third switching position.
Figure 6:
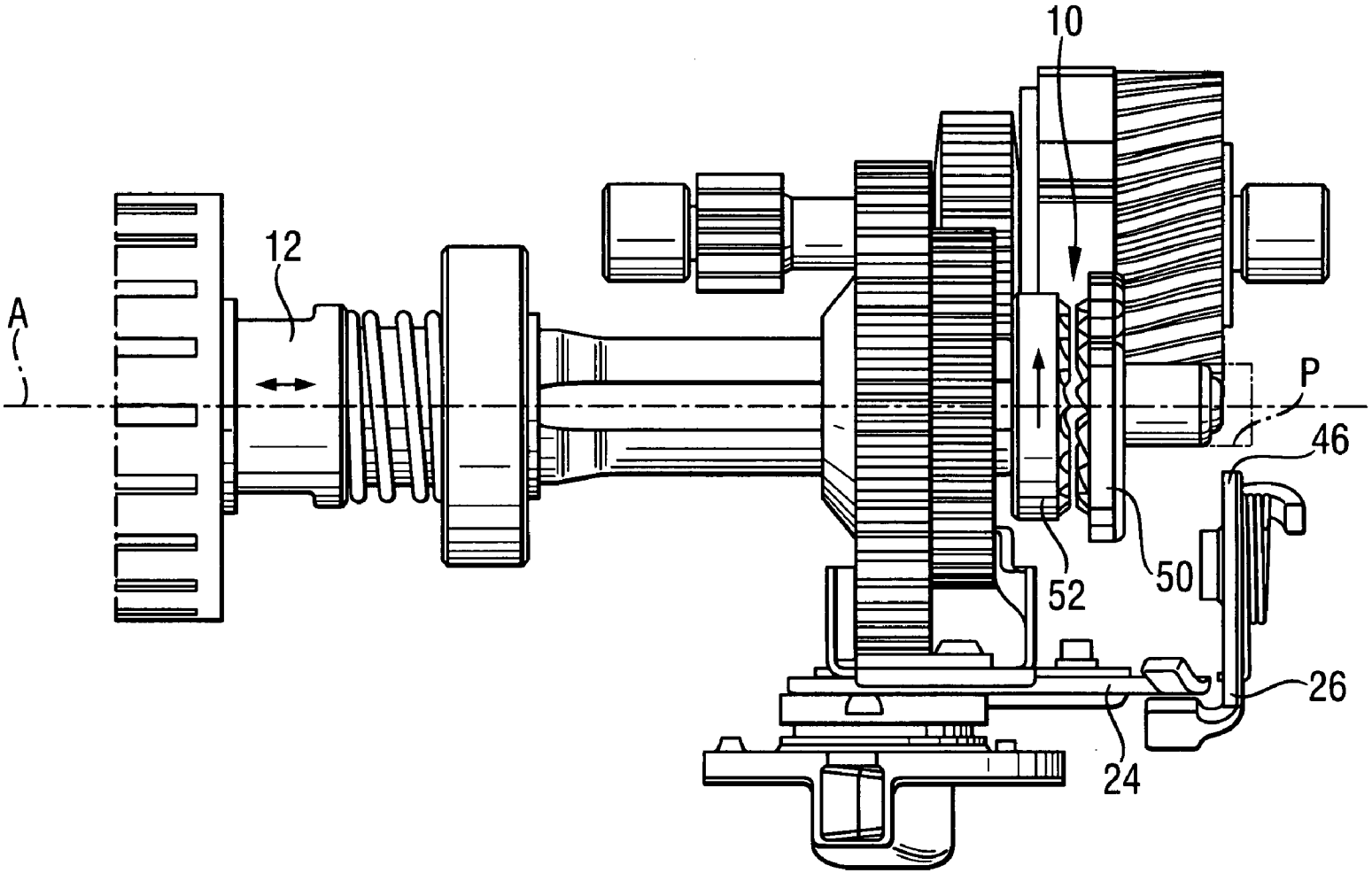
FIG. 6 a direct top view of the top of the switching arrangement according to FIG. 5.

Based on this second rotational position, the mode switch 4 can be rotated farther in rotating direction D and the cam element 30 can accordingly be swiveled farther in swiveling direction R. The switch-side swiveling member 24 is swiveled in such a way by means of the engagement with the cam element 30 that the second swiveling arm 32 is pressed against the carrying member 42 in direction M by the contacting member 40. Therefore, the swiveling member 26 on the impact mechanism side is swiveled against the force of the spring 54. However, the shift element 20 and the gear unit switching means 16 as a whole remain in the second switching step. In this way, after a rotation of the mode switch 4 by about 80° to 90°, a third rotational position of the mode switch 4 is reached and a third switching position of the switching arrangement 15 is reached according to FIGS. 5 and 6.

In this third switching position of the switching arrangement 15, the swiveling mechanism formed by the swiveling members 24, 26 is moved into an active position in which the impact mechanism 10 can be activated. For this purpose, the blocking stop 46 is moved completely out of the axial movement path P of the displaceable tool spindle 12 so that its displacement in axial direction toward the rear is no longer blocked in operation.

During operation, by pressing the hand-held power tool 2 against a substrate, not shown, to be machined, the tool spindle 12 can accordingly be moved along the axial movement path P. In so doing, the moving ratchet disk 52 rotating along with the tool spindle 12 comes into recurring contact with the fixed ratchet disk 50 and accordingly applies recurring impacts to the tool spindle 12 in a known manner along the work axis A.

Figure 7:
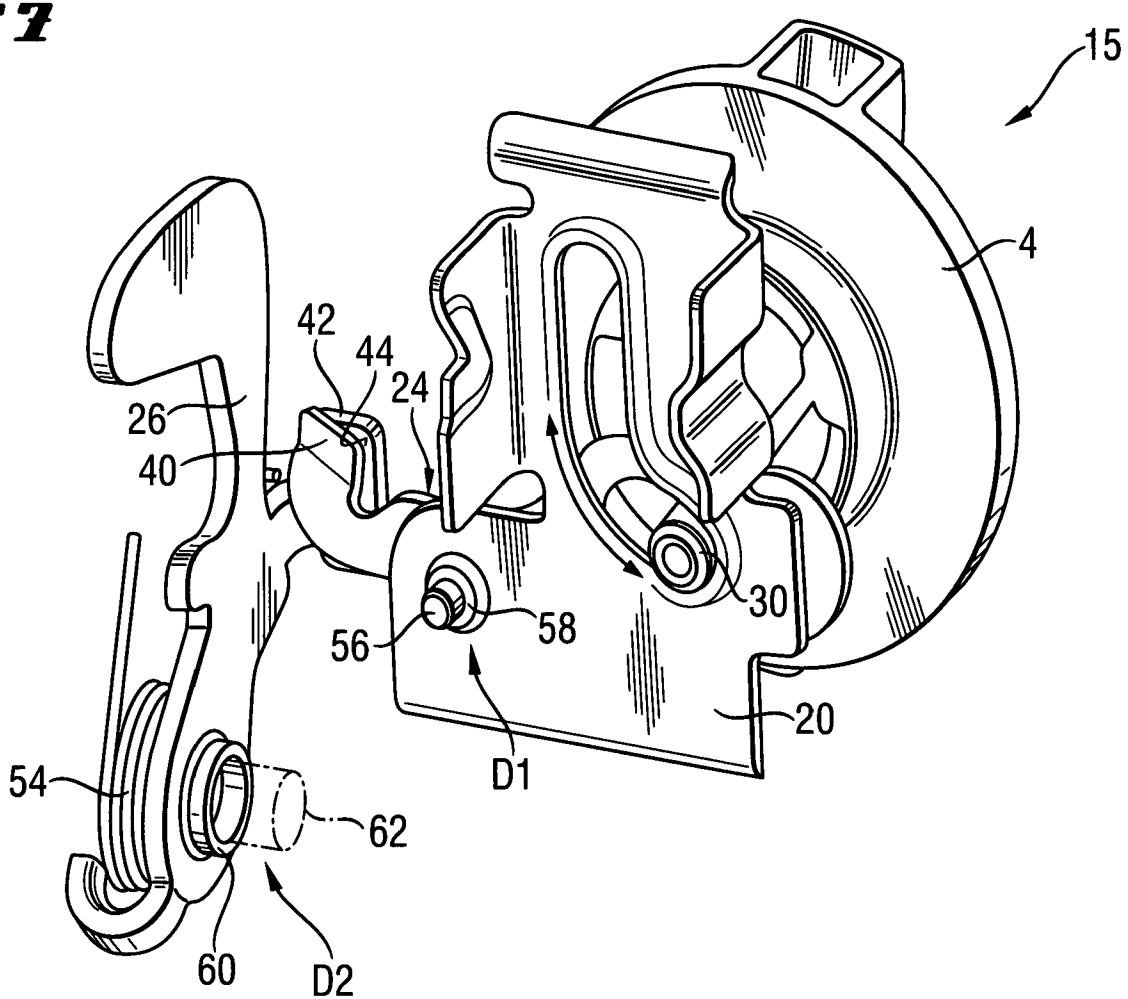
FIG. 7 a perspective view of the switching arrangement in isolation from one side of the gear unit.

FIG. 7 shows a top view of the switching arrangement 15 on the gear unit side in the third switching position in isolation. As can be see from this drawing, the first rotary bearing D1 is formed between the shift element 20 and the switch-side swiveling member 24 by a pin 56 which projects into a cylindrical receptacle 58. The pin 56 is fastened, for example, by orbital riveting, to the switch-side swiveling member 24 which is constructed as a bent-punched part. The cylindrical receptacle 58 is formed by a passage which is likewise produced, together with the rest of the shift element 20, by bending and punching a sheet metal part.

Further, the swiveling member 26 on the impact mechanism side is also formed as a bent-punched sheet metal part. The swiveling member 26 on the impact mechanism side forms a second cylindrical receptacle 60 which, together with a pin 62 which is stationary with respect to the housing, forms the second rotary bearing D2. The pin 62 which is stationary with respect to the housing is formed at a bearing plate 64 as can be seen particularly from FIG. 2.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A hand-held electric power tool (2), comprising:

a switching gear unit (6) having at least two switching stages;

an impact mechanism (10); and a mode switch (4) for switching the switching gear unit (6) back and forth between the at least two switching stages and for switching the impact mechanism (10) on and off, and a switching arrangement (15) having gear unit switching means (16) for connecting the mode switch (4) with the switching gear unit (6) and impact mechanism switching means (18) for connecting the mode switch (4) with the impact mechanism (10), the impact mechanism switching means (18) having a swiveling mechanism switchable by the mode switch (4) between an active position in which the impact mechanism (10) is switched on, and a passive position in which the impact mechanism is switched off;

wherein the swiveling mechanism has a switch-side swiveling member (24) which is held so as to be swivelable at a first rotary bearing (D1), is movement-coupled with the mode switch (4), and is actuated by actuating means, depending on the position in which the impact mechanism (10) is switched on or off; and wherein the actuating means comprises a swiveling member (26) on the impact mechanism side that is held at a second rotary bearing (D2) so as to be swivelable transverse to the switch-side swiveling member (24).

2. A hand-held electric power tool according to claim 1, wherein both the gear unit switching means (16) and the impact mechanism switching means (18) are movement-coupled with the mode switch (4).

3. A hand-held electric power tool according to claim 1, wherein both the switch-side swiveling member (24) and the gear unit switching means (16) are actuated by a cam element (30) which is provided on the mode switch (4).

4. A hand-held electric power tool according to claim 1, wherein the swiveling member (26) on the impact mechanism side has a blocking stop (46) with which a first ratchet disk (50) of the impact mechanism (10) is spaced from a second ratchet disk (52) in the passive position.

5. A hand-held electric power tool according to claim 4, wherein the swiveling member (26) on the impact mechanism side is swiveled by the switch-side swiveling member (24) in an active position thereof into a position in which the spacing of the ratchet disks (50, 52) by the blocking stop (46) is canceled.

6. A hand-held electric power tool according to claim 4, wherein the second swiveling member (26) is biased in a passive position thereof.

7. A hand-held electric power tool according to claim 6, comprising a leg spring (54) for biasing the second swiveling member (26) in the passive position thereof.

8. A hand-held electric power tool according to claim 1, wherein the switch-side swiveling member (24) and the swiveling member (26) on the impact mechanism side are formed as bent-punched parts.

9. A hand-held electric power tool according to claim 1, wherein the gear unit switching means (16) has a shift element (20) for displacing a gear group (22) of the switching gear unit (6) between the switching stages and which is formed as a bent-punched part.

10. A hand-held electric power tool according to claim 9, wherein the first rotary bearing (D1) is provided between the switch-side swiveling member (24) and the shift element (20) and is formed by a pin (56) which penetrates into a passage.

* * * * *